United States Patent [19]

Willis

[11] Patent Number: 5,047,001

[45] Date of Patent: Sep. 10, 1991

[54] METHOD FOR CONSTRUCTING A REVERSIBLE DUFFLE BAG

[76] Inventor: James E. Willis, 4615 N. 22nd St., #104, Phoenix, Ariz. 85016

[21] Appl. No.: 574,515

[22] Filed: Aug. 28, 1990

Related U.S. Application Data

[60] Continuation of Ser. No. 387,226, Jul. 28, 1989, abandoned, which is a division of Ser. No. 191,428, May 9, 1988, abandoned.

[51] Int. Cl.[5] ..... B31B 49/04

[52] U.S. Cl. ..... 493/267; 112/262.2; 493/213; 493/214; 493/379

[58] Field of Search ..... 493/186, 210, 213, 214, 493/217–219, 267, 379, 384, 386, 387; 112/262.2, 262.1, 402

[56] References Cited

U.S. PATENT DOCUMENTS

| | | | |
|---|---|---|---|
| 1,677,743 | 4/1928 | Berton . | |
| 1,776,983 | 9/1930 | Rotherham . | |
| 2,037,175 | 4/1936 | Northcross | 493/210 |
| 2,673,024 | 3/1954 | Kuss | 229/57 |
| 3,109,474 | 11/1963 | Levi | 112/262.2 |
| 3,340,969 | 9/1967 | Rothberg | 190/1 |
| 3,630,798 | 12/1971 | Wicks | 493/217 |
| 4,136,723 | 1/1979 | Skaadel et al. | 150/1 |
| 4,195,378 | 4/1980 | Parker | 5/419 |
| 4,535,878 | 8/1985 | Grahl | 190/1 |
| 4,546,507 | 10/1985 | Weinstein | 5/419 |
| 4,584,705 | 4/1986 | Mykleburst et al. | 383/8 |
| 4,607,388 | 8/1986 | Koiyumaki et al. | 383/121 |
| 4,637,063 | 1/1987 | Sullivan et al. | 493/214 |
| 4,639,958 | 2/1987 | Lerner | 5/418 |

FOREIGN PATENT DOCUMENTS

| | | | |
|---|---|---|---|
| 1130350 | 2/1957 | France | 383/75 |

*Primary Examiner*—Frederick R. Schmidt
*Assistant Examiner*—Jack Lavinder
*Attorney, Agent, or Firm*—Body, Vickers & Daniels

[57] ABSTRACT

A unique method for constructing a bag for use as a pillow and a receptacle having a first side of a moisture-proof material and an opposite second side having a moisture-proof panel and a soft panel. In one configuration whth the first side as the outer side, the bag serves as a receptacle for camping items such as a sleeping bag. In the reverse position with the second side as the outer side, the bag may be filled with soft clothing items and used as a pillow with the moisture-resistant panel of the second side engaging the ground and the softer panel adapted to receive the head of the user.

7 Claims, 4 Drawing Sheets

FIG. 11
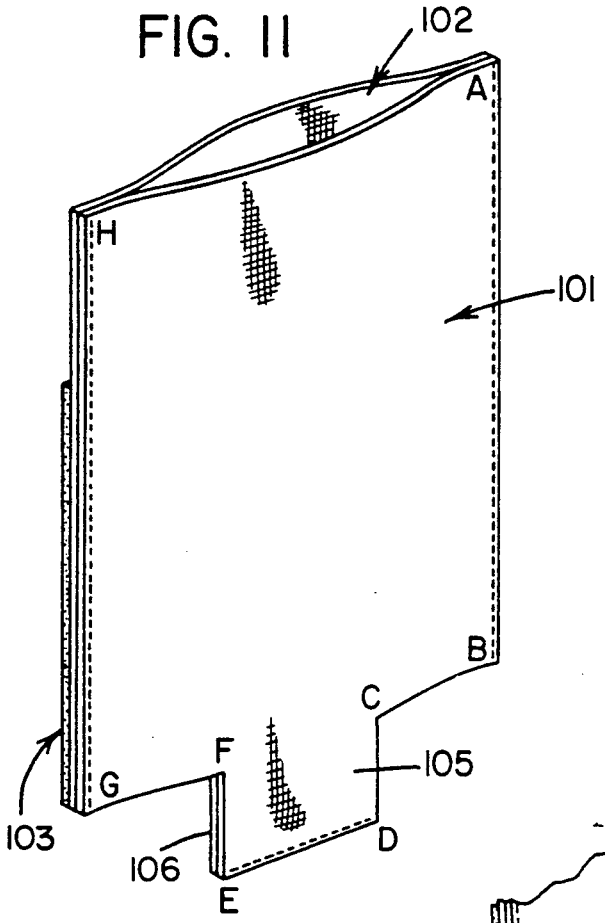
FIG. 12
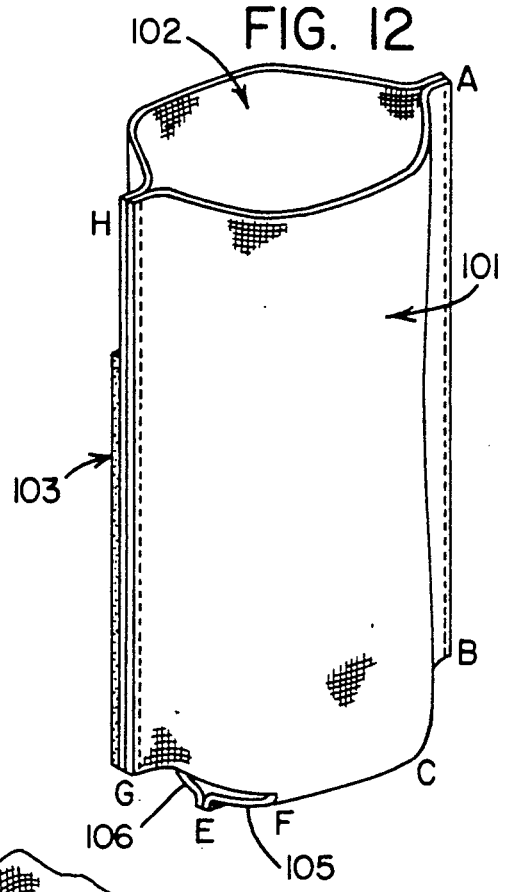
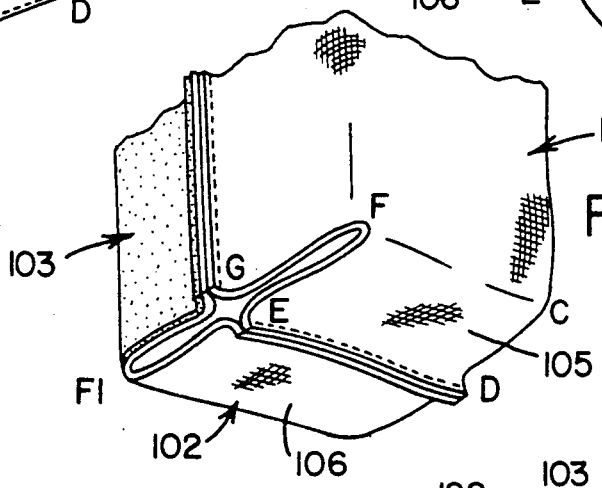
FIG. 13
FIG. 14
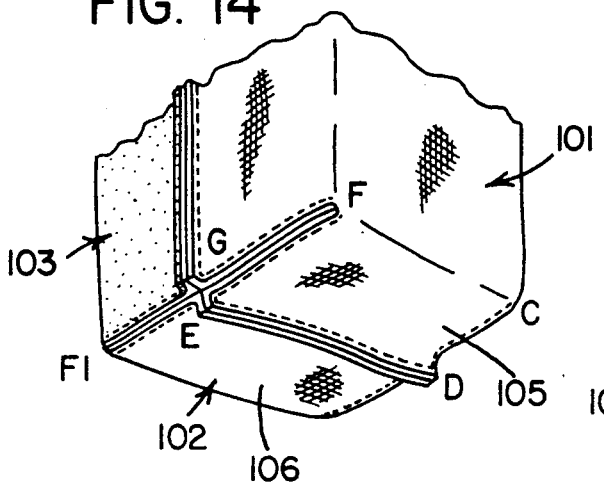
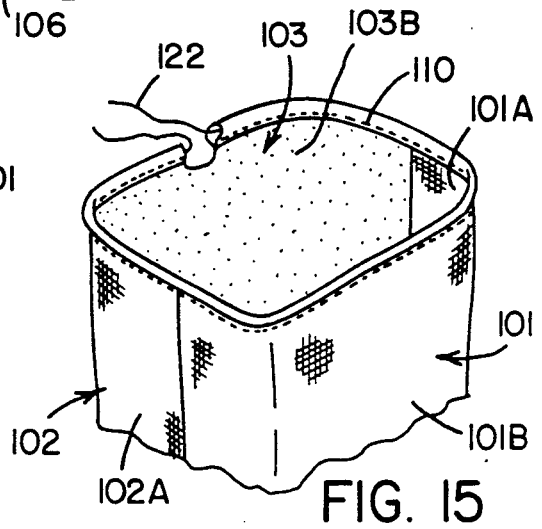
FIG. 15

METHOD FOR CONSTRUCTING A REVERSIBLE DUFFLE BAG

This is a continuation of Ser. No. 387,226 filed July 28, 1989 now abandoned, which is a division of application Ser. No. 191,428 filed May 9, 1988 now abandoned.

The present invention relates to a soft storage accessory and more particularly relates to a reversible duffle bag or stuff sack which in one position serves as a storage sack and when reversed may be filled with various soft articles and the bag utilized advantageously as a pillow for sleeping or resting in a supine or prone position.

BACKGROUND OF THE INVENTION

Camping and other outdoor activities require the individual to carry various articles of clothing and accessories such as sleeping bags, camping gear, personal hygiene items and the like. Campers and hikers are particularly restricted in the number of clothing and convenience items that can be utilized in these outdoor activities since these items often must be transported by the individual on a pack frame or knapsack. Accordingly, many convenience and comfort items must be left behind in favor of basic items needed for such activities. Generally a sleeping bag is considered to be an essential item while a pillow is not such a necessary item and is often left behind. Most campers must substitute a rolled-up item of clothing or some other article for a pillow for supporting the person's head while sleeping or resting. Accordingly, there exists a need for a duffle bag which can be utilized to carry accessory items, as for example a sleeping bag, and which at the camp site can be used as a pillow for supporting the head of a person while resting or sleeping.

Several patents can be found in the prior art which provide for the transportation or storage of various items used in outdoor activities and which may also be used as a pillow or mat or pad for reclining. For example, U.S. Pat. No. 4,195,378 shows an oversized beach towel which is provided with pockets at one end which are designed for the receipt of various items that may be brought to the beach. Waterproof zippers and linings protect the contents of the pocket. The towel unit includes a removable handle to be used for retaining the towel and its contents in a convenient package when the towel is rolled or folded.

U.S. Pat. No. 4,546,507 shows a beach kit having an inflatable pillow and pillow cover in which the inflatable pillow is received. The pillow cover is convertible into a carrying case.

U.S. Pat. No. 4,639,958 discloses a combined head rest, sun shade and bag. The head rest also serves as a closable bag for receiving various articles.

U.S. Pat. No. 4,535,878 discloses a pillow tote bag for outdoor use for carrying accessories and which provides a face and head rest.

While the above patents shows various items which are multiple purpose and which provide a certain degree of convenience to the user, none of the devices are designed for campers and none are reversible to provide a duffle bag in one configuration for the reception of clothing and other camping articles, and in the reverse configuration to serve as a comfortable pillow.

Briefly, the present invention provides a duffle bag which is reversible. The side of the bag which would normally be the outside is fabricated from a moisture-proof or moisture-resistant material such as rip stop nylon. When this side is the exposed outer side, the bag may be used as a stuff sack. When the bag is reversed, the second side, which is within the bag when it is configured as a stuff sack, becomes the exterior side and the sack may be stuffed with articles of clothing to provide a soft and clean camping pillow. The second side is comprised of two panels of material; one a moisture-proof or moisture-resistant material such as a rip stop nylon which normally would be placed in contact with the ground, and the other section of a soft fleece material such as polar fleece to provide a comfortable surface to receive the head or face of the user when used as a pillow. The bag is provided with a closure such as a drawstring. The bag of the present invention may be used by campers and hikers, and may also be used as a day pack by school children. The bag may also be used as a ditty bag for weekend and overnight sailors.

SUMMARY OF THE INVENTION

Accordingly, it is an object of the present invention to provide a combination duffle bag and pillow which is reversible and can be used in one configuration as a duffle bag and reversed to another configuration to serve as a pillow.

Another important object of the present invention is to provide a combined pillow and duffle bag which can be advantageously used to carry personal and camping items such as a sleeping bag and clothing and which at the final destination can be used as a pillow device providing a water and weatherproof section and a softer section for the reception of the head or face of the user.

Another important object of the present invention is to provide a unique and efficient method of constructing the bag.

BRIEF DESCRIPTION OF THE DRAWINGS

The above objects and advantages of the invention will be more readily understood and appreciated from the following specification and by reference to the accompanying drawings in which:

FIGS. 10 to 15 show an alternate method of constructing the bag of the present invention.

DESCRIPTION OF THE PREFERRED EMBODIMENT

Figure 1:
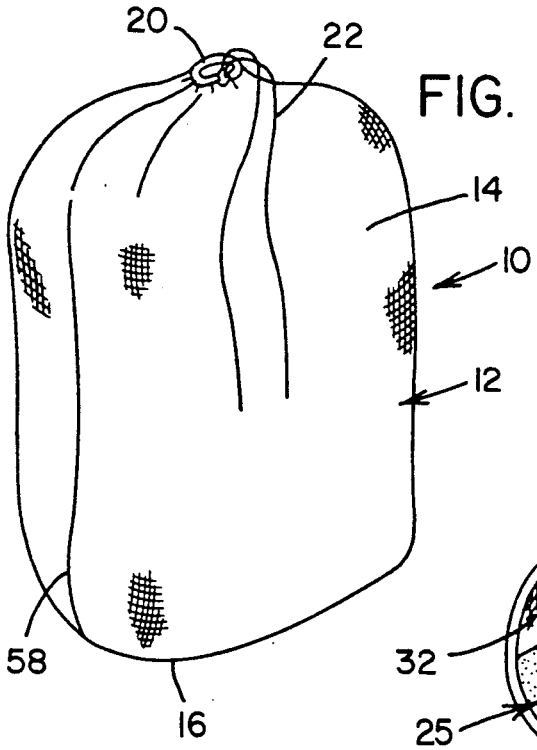
FIG. 1 is a perspective view of the duffle bag of the present invention in one configuration.
Figure 2:
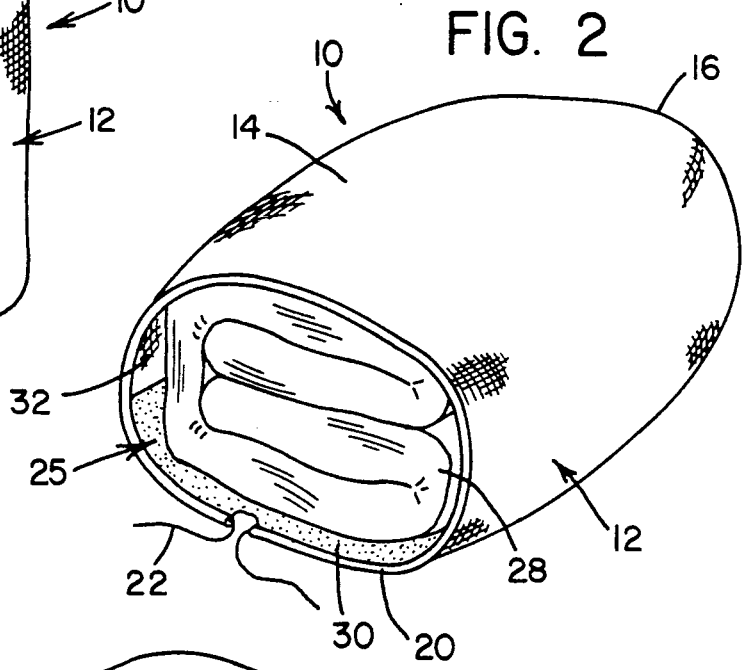
FIG. 2 is an end perspective view of the bag in an open position with a sleeping bag contained therein.

Referring now to the drawings, particularly FIGS. 1, 2, 7 and 8, the duffle bag of the present invention is generally designated by the numeral 10. FIG. 1 illustrates the bag of the present invention in a configuration which normally would be used for carrying items with the exposed surface 12 being a moisture-resistant material such as rip stop nylon. The term "moisture-resistant" is used throughout in a broad sense to include materials that are waterproof as well as those that are moisture resistant or moisture repellant. Bag 10 has a body 14 with a bottom 16. The bag is shown as cylindrical but may be other shapes such as square or rectangular in cross-section. The upper edge of the body 14 is provided with a casing 20 which receives a drawstring 22 so the bag may be closed and opened for access to the interior compartment 25. The drawstring 22 may be drawn and tried to secure the contents of the interior compartment. In the configuration shown in FIGS. 1 and 2, exterior 12 is a moisture-proof material. Bag 10 is particularly suited for containing items used in camping and similar outdoor activities. The cylindrical configuration is generally preferred as it lends itself to the containment of such items as a sleeping bag 28. The sleeping bag 28 may be stuffed within compartment 25 as seen in FIG. 2 and the drawstring drawn tight. Thus, the bag provides a convenient and moisture resistant receptacle for storage and for transportation of sleeping bag 28.

Figure 4:
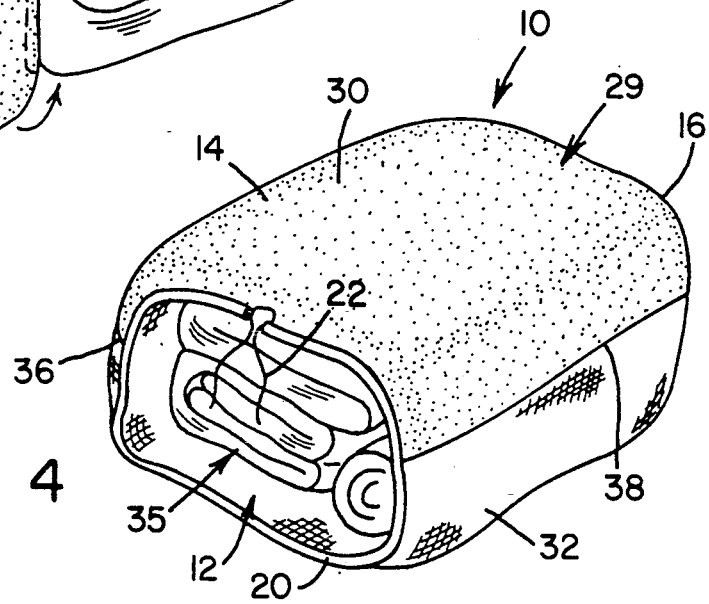
FIG. 4 is an end perspective view of the open bag in a configuration for use as a pillow.
Figure 5:
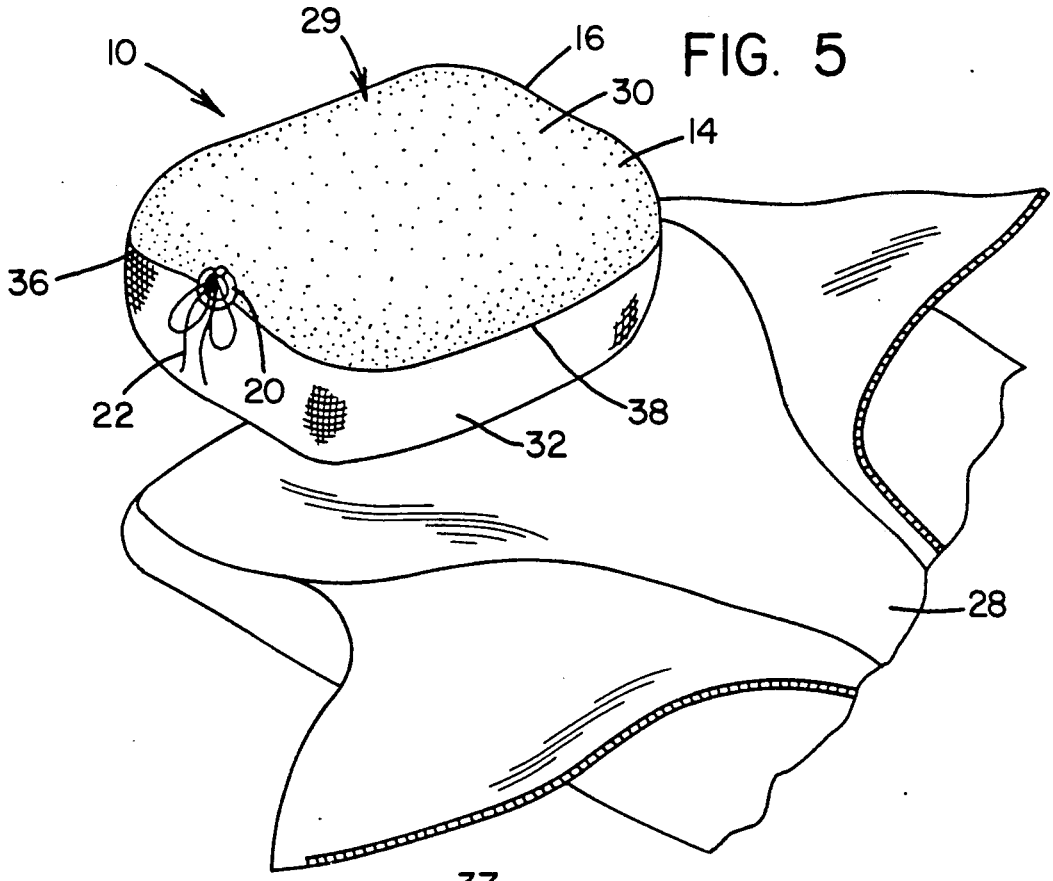
FIG. 5 is a perspective view of the bag of the present invention in use as a pillow.

In FIGS. 4 and 5, bag 10 is shown in a reverse configuration. Surface 12 now occupies a position on the inside of the bag and surface 29 is outwardly exposed. Surface 29 is comprised of two panels, 30 and 32, which as shown are joined as by sewing along longitudinal seam lines 36 and 38 extending at opposite sides of the body 14 and along the bottom edges of the panels to provide a closed bottom end for the body 14 while leaving the upper edges of the panels unsewn to provide a top opening into the bag. Panel 30 is preferably a soft material such as a polar fleece material. Panel 32 is a moisture or waterproof material such as rip stop nylon. In the configuration as seen in FIG. 4, bag 10 may be stuffed with soft articles 35 of clothing such as sweaters, pants, socks and the like, and the bag can then be used as a clean, soft pillow for comfortably supporting a person's head. Thus, when the camper wishes to use sleeping bag 28, the sleeping bag is removed from the duffle bag of the present invention. As a duffle bag, the bag would have the configuration shown in FIG. 1. When the sleeping bag 28 is removed, the bag may be reversed in the configuration shown in FIG. 4 and filled with soft articles of clothing 35 and placed with panel section 32 engaging the ground. The softer fleece section 30 is positioned upwardly to receive the head of the person.

The bag of the present invention is also suited for use as a children's day pack. In most states, health laws require that small children attending day care centers bring their own pillow and blanket for naps. The blanket and pillow must be taken home at the end of each school day. Thus, the reversible duffle is ideal for transportation of the child's blanket, pillow and other personal items.

Figure 9:
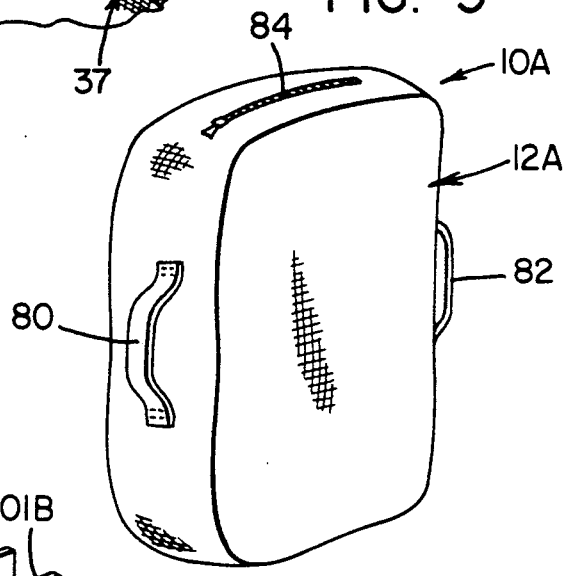
FIG. 9 is a perspective view of an alternate embodiment of the present invention.

In FIG. 9 duffle bag 10A is shown generally constructed as described with reference to FIGS. 1, 2, and 7 but is provided with straps 80 and 82 sewn to opposite sides of exterior 12A. The straps 80 and 82 form loops which allow the user to easily transport the bag which straps are particularly helpful to the small child. The closure 84 is shown as a zipper rather than a drawstring as previously described. The bag is reversible having an opposite surface formed from two panels, one being softer material and the other being a moisture-resistant material. In FIG. 9, the opposite surface occupies a position at the interior and is not seen. Embodiment 10A is also well suited for use as a sailor's ditty bag.

Figure 6:
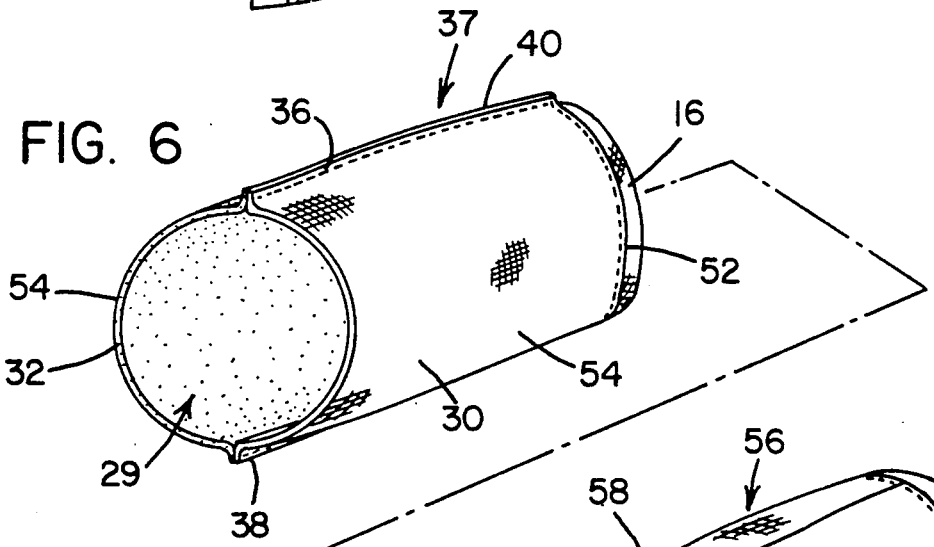
FIGS. 6 and 7 show the operations involved in one method of constructing the bag.
Figure 7:
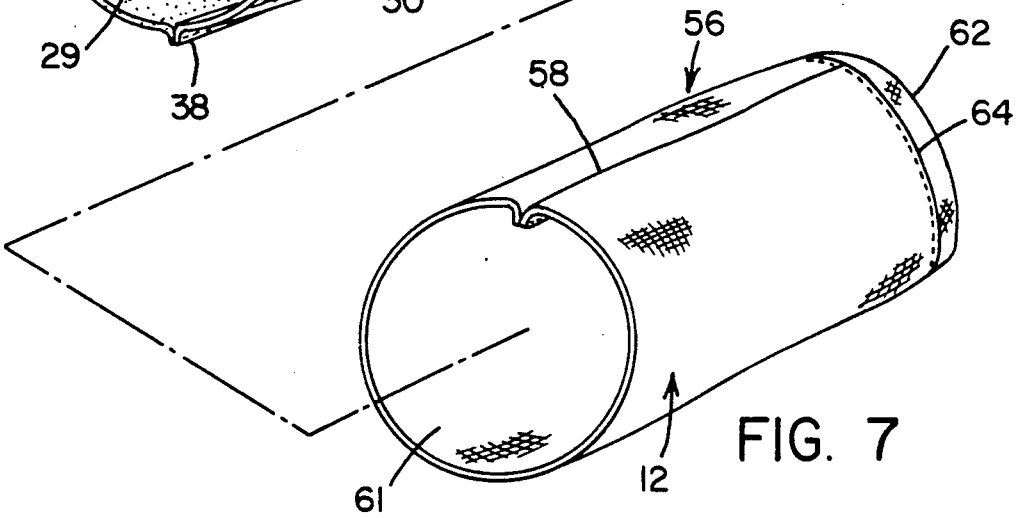

FIGS. 6 and 7 illustrate one method of constructing the reversible duffle bag of the present invention. A first bag component 37 comprised of two generally rectangular panels 32 and 30 is first formed. The panels are joined at opposite longitudinally extending seams 36 and 38 forming generally cylindrical bag component 37. The seams are sewn in conventional manner leaving an unfinished edge 40 at one surface 54 of the bag component 37 and finished seams 36 and 38 along with opposite surface 29 of the component 37. A bottom 16, which may be round or square, is formed from a waterproof material such as rip stop nylon and stitched at seamline 52 to the lower horizontal edge of component 37. As shown, the top edges of the panels 30, 32 are left unsewn to provide an opening into the bag compartment. The resulting construction is a cylindrical member constructed of panels 30 and 32 having a finished interior surface 29 and an opposite unfinished exterior surface 54 on which side the exposed edges 40 appear. In sewing operations the finished or obverse side 29 is often termed the "right" side and the reversed unfinished side 54 is termed the "wrong" side of the sewn article.

Next, a second bag component 56 is formed from a single rectangular sheet of rip stop nylon or similar water or moisture-proof material. As is shown in FIG. 7, this component 56 is dimensioned substantially the same as component 37 consisting of the joined panels 30 and 32 of nylon and fleece. Bag 56 is cylindrical and stitched along seamline 58 having a finished surface 12 and an unfinished surface 61. A bottom 62 is stitched along seamline 64 at the lower horizontal edge of the completed bag 56 and, as shown, the open top of the second bag component 56 provides an opening into the interior thereof.

Figure 8:
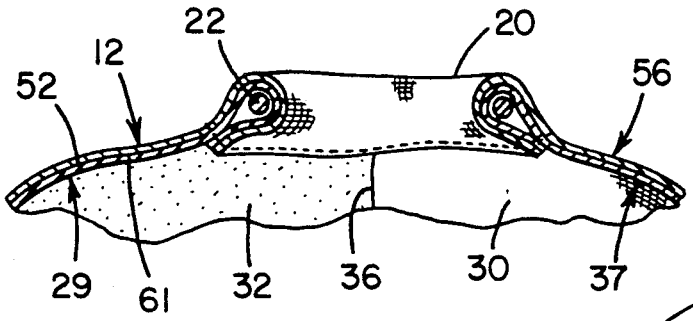
FIG. 8 is a detail sectional view of a portion of the top of the bag and closure.

The complete duffle bag of the present invention is then assembled with bag 37 installed within the bag 56. For example, if bag 56, as shown, is the exterior bag, it is positioned with its obverse "right" side 12 facing outwardly. Bag 37 is slipped within the exterior bag 56 with its obverse "right" side 29 facing inwardly so that the "wrong" side of the two bags are interiorly adjacent. The bags are sewn together at selected locations and the upper edges of the bag joined and rolled as shown in FIG. 8 to form a casing 20 about a drawstring or cord 22. The casing is slit at an appropriate location and the opposite ends of the drawstring are extended through the slit. The resulting construction is the bag having opposed surfaces which may be selectively positioned on the exterior depending upon the intended use of the bag.

Figure 10:
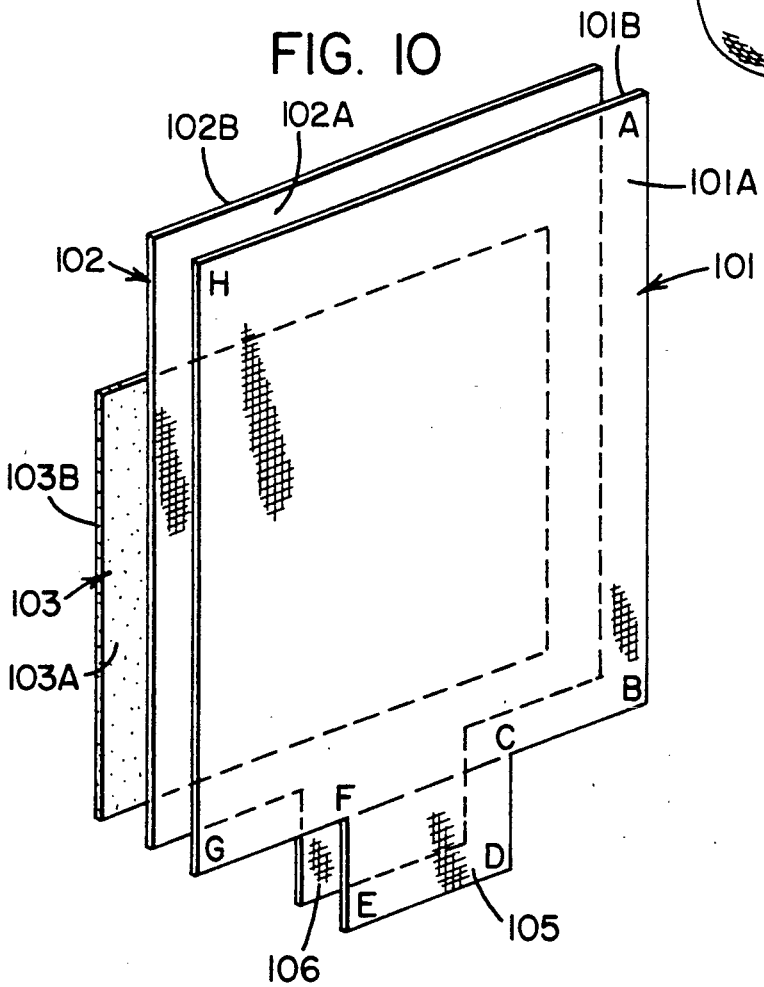

In constructing the bag in accordance with the steps shown in FIGS. 10 and 15, sheets 101 and 102 are first cut to size from moisture-resistant material such as rip stop nylon. Sheets 101 and 102 are each generally rectangular having a centrally projecting flap 105, 106 extending from the bottom edge of the material. A generally rectangular piece of soft fleece-like material 103 is cut having a width corresponding to the width of sheets 101 and 102 but having an overall height less than sheets 101 and 102. The sheets are arranged in juxtaposition as shown in FIG. 10 with their bottom edges aligned and sheet 102 intermediate sheets 101 and 103. Vertical seam HG is sewn through all three layers as is seam AB along the opposite edge. Sheets 101 and 102 are sewn together at the lower edge of tab 105 along seam ED resulting in the construction of FIG. 11. Fold FC is then grasped and pulled outwardly as shown in FIG. 12 and seam ED becomes aligned with points G and B, as seen in FIG. 13. Seams F on sheet 101 and seams F1 on sheet 102 are then sewn as shown in FIG. 14. The partially completed item is now turned inside-out between sheets 101 and 102 so that side 101A of sheet 101 is adjacent of side 103B of sheet 103. Sheet 102, side 102B is adjacent to side 103A of fleece material 103. The exterior is now formed by sides 101B and 102A.

The next step is shown in FIG. 15. The upper margin of sheets 101 and 102 are rolled wrapping around drawstring 122. A peripheral seam 110 is applied forming a casing for the drawstring like that shown at 20 in FIGS. 1–4.

If a round shape is desired, tabs 105 may be omitted and the construction of the bag is turned inside-out between sheets 101 and 102. A circular bottom is then sewn to sheets 101 and 102.

The advantages to the foregoing method of construction is that only three sheets of material are required. The method requires less material sewing, less operations and is more efficient resulting in a lighter finished item.

Figure 3:
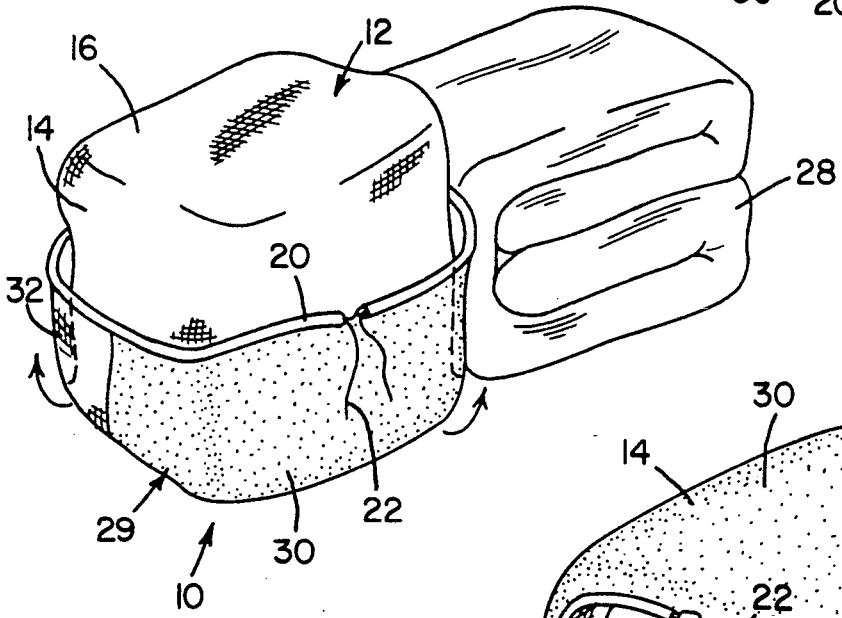
FIG. 3 is a perspective view of the bag of the present invention in a partially reversed configuration from that shown in FIGS. 1 and 2.

FIGS. 1 to 5 illustrates the dual use of the bag. In FIGS. 1 and 2 the duffle bag 10 is shown in a configuration having moisture-proof surface 12 exposed and panels 30 and 32 as the interior surface. With the surface 12 exposed, the bag serves as a useful and protective receptacle for camping gear, particularly such items as a sleeping bag 28. When it is desired to use the bag as a pillow, the sleeping bag 28 is removed and the duffle bag reversed as shown in FIG. 3 which is accomplished by grasping the upper edge of the bag and pulling it toward the bottom of the duffle bag. This operation results in surface 29 and panels 30 and 32 assuming a position at the outer surface. Surface 12 then forms the interior surface of the bag about compartment 25. Compartment 25 may be filled with soft articles 35 such as shirts, trousers and sweaters and when this is accomplished, drawstring 22 may be pulled tight and the bag serves as a convenient pillow for reception of the head of the user. In this configuration, as seen in FIG. 5, the portion of the outer surface defined by panel 32 is preferably placed downwardly in contact with the ground and the softer fleece portion defined by panel 30 is oriented upwardly. The fleece panel provides a soft and clean pillow surface to receive the user's head.

Thus, it can be seen from the foregoing, the present invention provides a highly unique and advantageous construction that has dual purpose and is reversible and can be used as a receptacle for storing and transporting outdoor gear and when reversed can provide a comfortable and soft pillow support.

While a preferred embodiment of the invention has been described above, such description is for illustrative purposes only it being understood that various changes and modifications may be made without departing from the spirit and scope of the appended claims.

Having thus described the invention; it is claimed:

1. A method of making a soft duffle bag for use as a pillow and receptacle comprising:

(a) providing a unitary first and unitary second panel of moisture-resistant material, each panel being generally rectangular and of equal dimensional size and having a top edge, a bottom edge and opposite side edges;

(b) providing a unitary third panel of a softer material, said third panel being generally rectangular having a top edge, bottom edge and opposite side edges with the side edges being shorter than the side edges of the said first and second panels;

(c) positioning said first, second and third panels with the first and second panels in flatwise engagement and the second and third panels in flatwise engagement with the side and bottom edges of all said panels in substantial alignment and the top edges of said first and second panels in substantial alignment;

(d) sewing said first, second and third panels flatwise together along said side edges and joining said panels together at their said bottom edges while leaving the said aligned top edges of said first and second panels unsewn to form a bag with a closed bottom end and an open top end at the said unsewn top edges of said first and second panels; and, (e) reversing said first and second panels by turning said bag inside out through the said open top end thereof whereby said first and third panels are adjacent one another forming a bag having one side consisting of said unitary first panel of moisture-resistant material and an obverse side consisting of said unitary third panel of softer material layered against the inside surface of said unitary second panel of moisture-resistant material wherein said first and second panels each have a flap projecting from the central regions of and of substantial shorter length than the bottom edges thereof and having a bottom edge portion and opposite side edge portions and wherein said flaps of said first and second panels are sewn together along their respective said bottom edge portions and their said side edge portions sewn to the said bottom edges of the same respective one of said panels at each side of said flaps to form a bottom for the bag.

2. The method of claim 1 including the further step of arranging a drawstring around the upper edge of said first and second panel and folding the upper edges thereof over said drawstring to form a casing and securing said casing by stitching the said folded upper edges to the respective said panels to form a retaining closure for said drawstring.

3. The method of claim 1 further including the step of joining the said panels together at their said bottom edges by sewing a generally circular-shaped bottom to the bottom edges of said panels to form a bottom for the bag.

4. A method of making a duffle bag for selective use in one configuration as a receptacle for various articles and in a reversed inside-out configuration as a pillowcase for filling with various soft articles for use as a pillow, said method comprising:

(a) constructing a first complete bag from a rectangular sheet of a generally moisture resistant material and having a generally cylindrical side wall and a closed bottom and an open top, said cylindrical side wall formed by stitching opposite side edges of said rectangular sheet together to form a longitudinally extending seamline providing the said bag with a finished surface and an opposite unfinished surface and said closed bottom being formed of a sheet of moisture resistant material stitched around the lower edge of the said cylindrical side wall, (b) constructing a second complete bag having a generally cylindrical side wall and a closed bottom and open top, said side wall being comprised of a moisture resistant panel and a soft fleece-like panel and being formed by stitching the opposite side edges of one of said panels to respective opposite side edges of the other one of said panels to form longitudinally extending seamlines providing the cylindrical wall of said second bag with a finished interior surface and an unfinished exterior surface and said closed bottom being formed of a sheet of moisture-resistant material stitched around the lower edge of the said cylindrical side wall of said second bag;

(c) placing said second bag inside said first bag with their said open tops adjacent one another and with their said unfinished surfaces adjacent and facing one another, and joining said bags together around their upper edges bordering their said adjacent open tops and by sewing them together at selected locations thereof so that their said unfinished surfaces are held together in substantially inseparable facing relation to form a single unified bag assembly with a single interior bag compartment, and (d) forming a closure member around the said joined together upper edges of said bags with a drawstring retained therein to close off access to said single bag compartment through the said open tops of said joined together bags.

5. The method of claim 4, wherein the said closure member for the drawstring is formed by folding the joined together upper edges of said bags and stitching the said folded upper edges to said bags.

6. A method of making a soft duffle bag for selective use in one configuration as an article storage receptacle and in a reversed inside-out configuration as a pillow-case for filling with soft articles for use as a pillow, said method comprising:

(a) providing first and second panels of moisture resistant material, said panels being generally rectangular and of equal dimensional size and each having a top edge, a bottom edge and opposite side edges;

(b) providing a third panel of a softer material, said third panel being generally rectangular and having a top edge, a bottom edge and opposite side edges with its said side edges being shorter than the side edges of the said first and second panels and its said top and bottom edges of approximately the same length as the said top and bottom edges of said first and second panels;

(c) positioning said first, second and third panels with the first and second panels in flatwise engagement and the second and third panels in flatwise engagement with the side and bottom edges of all said panels in substantial alignment and the top edges of said first and second panels in substantial alignment; and (d) sewing said first, second and third panels flatwise together along their said side edges and spreading apart the said sewn together first and second panels and sewing to the bottom edges thereof a panel of moisture resistant material to form a bag with a closed bottom end and an open top end at the said unsewn top edges of said first and second panels.

7. The method of claim 6, including the further step of folding the upper edges of said first and second panels and stitching the said folded upper edges to said panels to form a casing for enclosing a drawstring.

* * * * *